United States Patent [19]

Pilczuk

[11] Patent Number: 4,559,859

[45] Date of Patent: Dec. 24, 1985

[54] MUSICAL INSTRUMENT

[76] Inventor: Eugene A. Pilczuk, 6986 Baumhoff Rd., NW., Grand Rapids, Mich. 49504

[21] Appl. No.: 514,563

[22] Filed: Jul. 18, 1983

Related U.S. Application Data

[63] Continuation-in-part of Ser. No. 397,842, Jul. 13, 1982, abandoned.

[51] Int. Cl.[4] ..... G10D 7/10

[52] U.S. Cl. ..... 84/394; 84/387 R; 84/388

[58] Field of Search ..... 84/380, 382, 387–401

[56] References Cited

U.S. PATENT DOCUMENTS

| | | | |
|---|---|---|---|
| 857,765 | 6/1907 | Smith | 84/387 |
| 1,170,800 | 2/1916 | Cheney | 84/387 |
| 1,232,069 | 7/1917 | Nelson | 84/394 |
| 2,798,402 | 7/1957 | Zottola | 84/398 |
| 3,861,264 | 1/1975 | Matsumoto et al. | 84/387 |
| 4,273,020 | 6/1981 | Happe | 84/394 |

FOREIGN PATENT DOCUMENTS

| | | | |
|---|---|---|---|
| 258819 | 4/1913 | Fed. Rep. of Germany | 84/395 |
| 525246 | 5/1931 | Fed. Rep. of Germany | 84/389 |

*Primary Examiner*—Lawrence R. Franklin

*Attorney, Agent, or Firm*—Price, Heneveld, Huizenga & Cooper

[57] ABSTRACT

A musical wind instrument of the type in which the pitch of the note to be produced is initially created by a person blowing the instrument, the instrument being provided with at least one elongated tubular section forming a sound path with two ends. This section has twelve segments arranged in tandem, the length and diameter of each segment being progressively greater in the direction the sound travels through the section. The length of each segment corresponds to the wave length of a different note of a chromatic scale. In addition, the boundary between adjacent segments is formed by an abrupt change in diameter and the boundary between adjacent segments is made from a softer metal than the segment walls themselves.

7 Claims, 11 Drawing Figures

MUSICAL INSTRUMENT

The instant application is a continuation-in-part of my previously filed application, Ser. No. 397,842, filed on July 13, 1982 now abandoned.

BACKGROUND OF THE INVENTION

The present invention relates to wind instruments which are played by an individual blowing into the same, and to a method of making such instruments. The present invention relates in particular to brass and woodwind instruments and a method of making such instruments.

Brass and woodwind instruments are historically quite old, even the modern versions of such instruments dating from the 1800's. It has long been recognized, however, that a "perfect" scale cannot be played on a brass or woodwind instrument. By failing to play a perfect scale, it is meant that while certain notes within a given octave played on a woodwind or brass instrument can be played on key, other notes in the same octave will play slightly sharp or flat.

The reason why a perfect scale cannot be played on such instruments can be illustrated with respect to a trumpet or a cornet. Trumpets and cornets typically have three valves which when activated singly or in combination change the effective length of the sound path in the instrument. The sound path length as well as the shape of the bore of the trumpet, trumpets typically having a cylindrical bore, affect the note that can be produced by the trumpet. The length of the sound path and the conical bore determine where the nodes and antinodes of the standing waves produced by the individual's embouchure will occur in the instrument. In the three-valve instrument such as a trumpet, the first valve is ideally designed to add two semitones and the second valve adds one semitone. The third valve is ideally designed to add three semitones; however, the third valve is typically played in combination with either of valves 1 or 2 or both. Each valve, in short, adds at least one semitone by valving the standing wave through an additional length of tubing on the instrument.

The problem with the three-valve instrument is that the three different lengths of tubes through which the valves direct the standing wave cannot be combined so as to produce a perfect sound path length for each of the thirteen notes in an octave. For instance, it is necessary in producing some notes that valves 2 and 3 be depressed simultaneously. In some brass instruments, depressing valves 2 and 3 simultaneously will produce a note which is sharp because the sound path is too short. However, if the sound path added by valve 2 were lengthened, the notes produced by activating valve 2 would be flat. Lengthening the sound path added by valve 3 would similarly affect the notes produced by valve 3 being played in combination with valve 1. In short, prior art trumpets and cornet are a product of compromise, some notes play sharp, others flat.

It is well known that the same problem is present in woodwind instruments. In a saxophone, for instance, the positioning of octave holes is a result of a compromise between which notes will play sharp and which notes will play flat.

SUMMARY OF THE INVENTION

The present invention is an improved brass or wind instrument which plays truer to pitch for any given note in an octave than any other prior brass or woodwind instrument. The truer scale is achieved by a novel acoustical shape of the tubular section through which the generated sound passes.

The present invention comprises a musical wind instrument of the type having an elongated tubular sound path and of the type where the pitch of the note to be produced by the instrument is initially created by a person blowing the instrument. The instrument has an elongated straight tubular section through which the generated sound passes. The improvement specifically resides in the elongated tubular section having a plurality of segments arranged in tandem, the inner diameter of each segment being constant throughout its length, both the length and inner diameter of each of the segments being progressively greater in the direction the sound moves through the sections. Each section is of a length and inner diameter such that the end of each section from which sound is emitted will be at the antinode of a particular note. The number of segments in the tubular section is equal to the number of notes and half-notes in an octave. The improvement is further characterized by the boundary between each segment and the next adjacent segment being defined by an abrupt change in diameter.

These and other features of the present invention will become more apparent upon reference to the drawings and written specification herein.

DETAILED DESCRIPTION OF THE PREFERRED EMBODIMENT

THE MUSICAL INSTRUMENT

Figure 1:
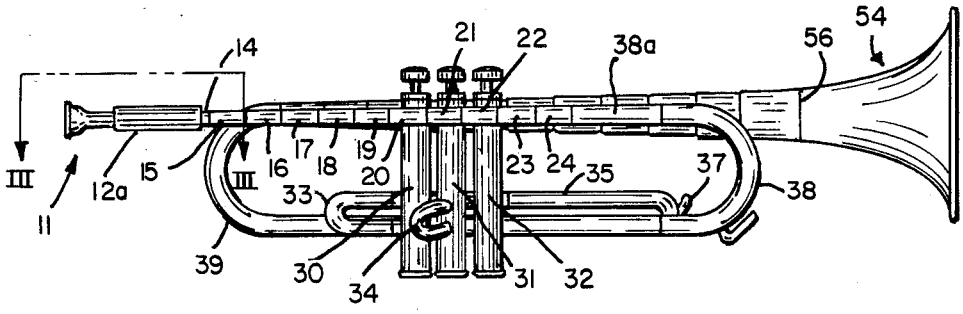
FIG. 1 is a side elevation of a trumpet incorporating the improvement of the present invention.
Figure 2:
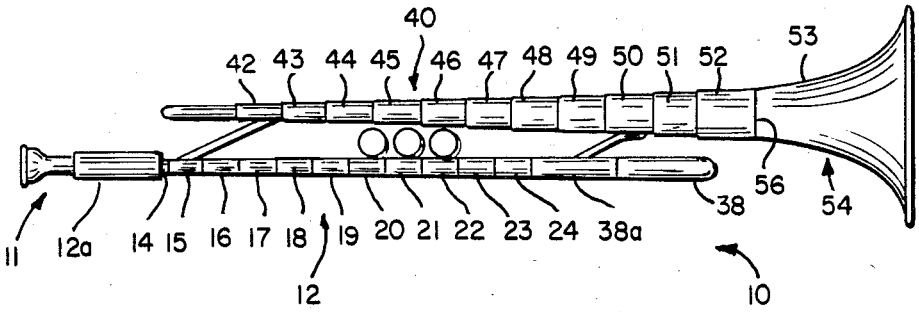
FIG. 2 is a top elevation of the trumpet of FIG. 1.

A trumpet incorporating improvements of the present invention is shown in FIGS. 1 and 2. The trumpet 10 comprises a mouthpiece 11, a mouthpipe 12, valves 30, 31, 32, first slide 33, second slide 34, third slide 35, water keys 36 and 37, a main slide 38, a bell pipe 40 and a bell 54. These features are conventional and well known in the prior art. An individual forming an embouchure and blowing into mouthpiece 11 can produce various musical tones through the bell 54 of the instrument. These tones can be varied by valves 30, 31 and 32 as is well known by many musicians.

As indicated above, the conventional trumpet does not play true to scale in that certain notes in an octave will either be sharp or flat. The sharpness or flatness of a given note can be adjusted by adjusting the lengths of valve tubes 33, 34 and 35, these tubes being frequently provided with sliding means so as to increase or decrease their lengths thereby increasing or decreasing the sound path through which the standing sound waves must travel. Other structural changes can be made to change the sharpness or flatness of a given note. For instance, the length of mouthpipe 12 and bell pipe 40 can be varied as well as the length of any tubing in-between the mouthpipe and bell pipe. In addition, the diameters of conventional mouthpipes and bell pipes can be varied. However, as indicated above, these adjustments, while perhaps correcting the sharpness or flatness of one note, invariably result in another note becoming sharp or flat.

The present improvement overcomes many of these problems of having many notes in an octave in a wind instrument being sharp or flat. The present invention is incorporated in mouthpipe 12 and/or bell pipe 40 each being comprised of a plurality of segments arranged in tandem, the segments having dimensions which will be described in more detail below.

The improvement of the present invention will first be described with reference to mouthpipe 12. As shown in FIGS. 1 and 2 mouthpipe 12 includes twelve segments 13–24. Each segment is arranged in tandem with two other segments. The inner diameter of each segment is constant throughout its length. However, as one proceeds along the sound path from the mouth piece 11 toward bell 54 in mouthpipe 12, the inner diameter of the segments becomes progressively greater. In addition, the length of each segment is progressively greater.

Figure 5:
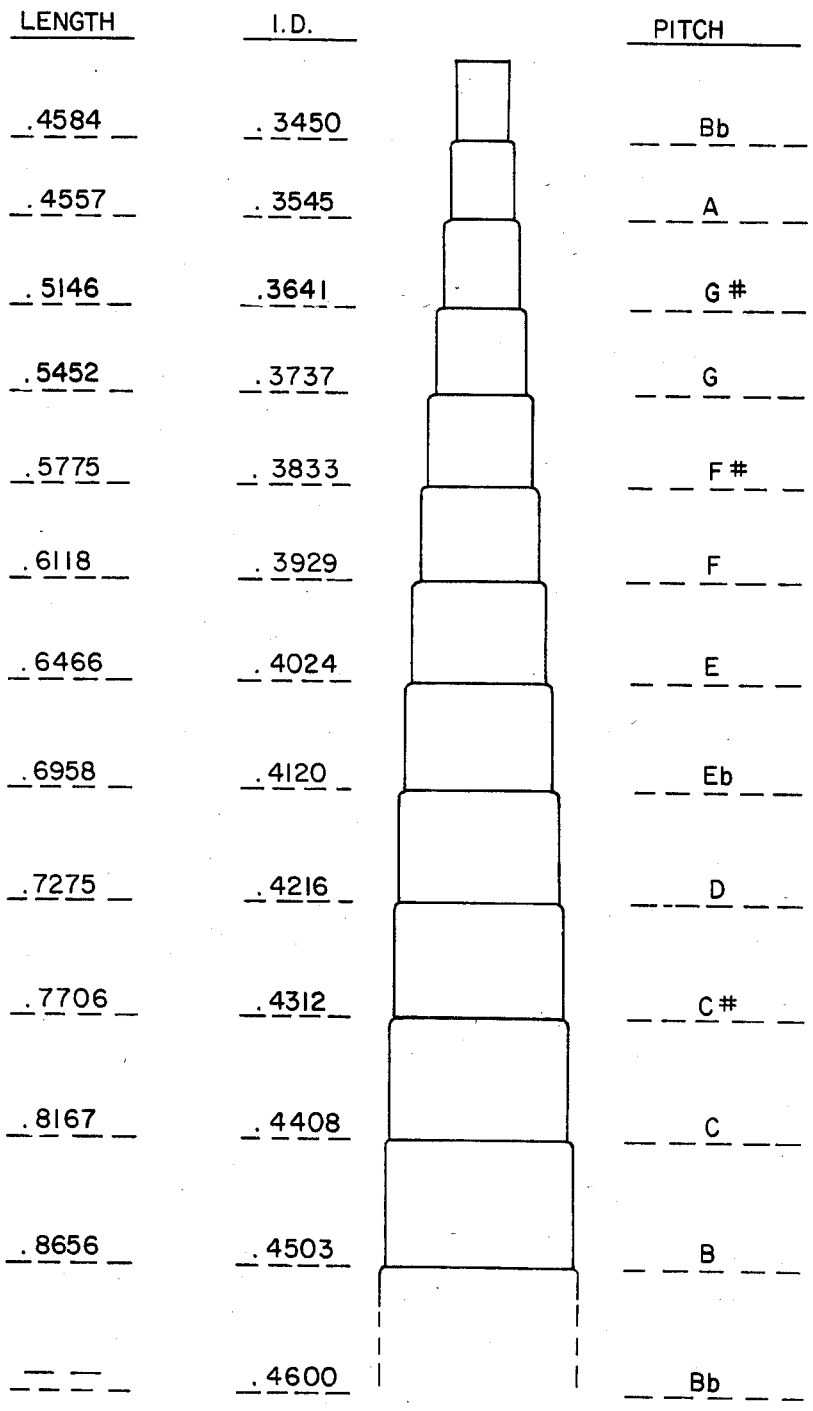
FIG. 5 is a schematic view of a mouthpipe of the present invention indicating the lengths and inner diameters of the various segments.

A mouthpipe of the present invention for a B flat trumpet is shown in FIG. 5. Pursuant to the description above, the inner diameter and the length of each segment progressively increases from the top of the figure to the bottom, the sound moving from the top segment to the bottom. Note that the scale of the mouthpipe shown in FIG. 5 is exaggerated, being expanded in the radial direction and contracted in the longitudinal direction. However, the lengths and inner diameters indicated for various pitches have been found to produce a trumpet which is truer to scale than any prior art trumpet.

As shown in FIG. 5 each segment is designed for a particular note. In particular, the length of each segment is designed such that the length of each segment corresponds to the wave length of a note in a chromatic scale. For instance, as shown in FIG. 5, the length of the segment corresponding to an "E" in a chromatic scale is 0.6466 inches. Assuming a speed of sound of 1140 feet/-second, this "E" has a frequency of 21,156.8 cycles/-second, which corresponds to a very high note virtually inaudible by human ears. This note is an "E" because by dividing its frequency by 2 repeatedly, frequencies of Es in other octaves can be obtained: 10,578.4, 5,289.2, 2,644.6, 1,322.3, 661.15, 330.6, 165.3 and so on. Taking a frequency, dividing it by 2 to obtain the same note an octave lower is a characteristic of the chromatic scale. These values of the Es for various octaves are comparable to those reported in the literature. The same calculations can be performed for the lengths of other mouthpipe segments, the length of each segment approximately corresponding to the wave length of a note in a very high octave.

Even though the length of each mouthpipe segment corresponds to the wave length of a virtually inaudible note, a surprising result has been achieved. The audible notes produced by a trumpet having such a mouthpipe are truer to scale than any other prior art wind instrument, as will be explained in more detail below.

The fact that the segmented portions are dimensioned lengthwise such that the dimensions corresponded to inaudible wave lengths or frequencies should not be construed so as to limit the scope of the present invention to segments corresponding to inaudible wave lengths. The segments have such relatively short lengths simply because a trumpet, for instance, would become extremely long if the segments had lengths corresponding to wave lengths of notes in lower octaves. The wave length of the standard "A" (440 cycles/second) is almost 2.6 feet, for example.

The diameters of the segments are very important in a production of a wind instrument having the desirable characteristics outlined above. As is well known by wind instrument manufacturers, the diameter of any part of the sound path can greatly affect the sound produced by the instrument. For instance, if the diameter of one portion of the sound path is constricted slightly due to a dent, nick or bend, the sound produced will be affected frequently for the worse.

The diameters of the wind pipe segments are chosen so as to increase incrementally from the diameter necessary at the mouthpiece and of the mouthpipe to the diameter necessary at the "sound emitting" end of the mouthpipe. The inside diameter of the smallest segment 13 of mouthpipe 12, for instance, is dictated by the inside diameter of the mouthpiece measured where the mouthpiece abuts the end of segment 13. As shown in detail in FIG. 3, mouthpiece 11 has an elongated tubular section 11*a* with an increasing inside diameter as one moves from the cup portion 11*b* of the mouthpiece to the end of tubular section 11*a*. The inside diameter of segment 13 is equal to the inside diameter of the end of tubular section 11*a*.

Figure 3:
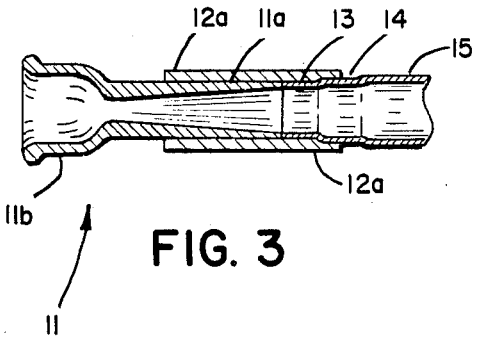
FIG. 3 is an enlarged sectional view of the mouthpiece, overpipe and mouthpipe of a trumpet and taken along plane III—III of FIG. 1.

The mouthpiece 11 is held against the open end of segment 13 by means of an overpipe 12*a*. Tubular section 11*a* of mouthpiece 11 is telescopically inserted into overpipe 12*a* until section 11*a* abuts the end of segment 13. Overpipe 12*a* telescopically receives segment 13 and part of segment 14 of mouthpipe 12 as shown in FIG. 3. Overpipe 12*a* is fixedly secured to mouthpipe 12.

The inside diameter of the largest mouthpipe segment 25 is equal to the inside diameter of the bore through tube 38A and main tuning slide 38 and tube 39.

The inside diameters of segments 14 through 24 progressively increase while the diameter of each individual segment remains constant. In fact, the increase in inside diameter from one segment to the next larger segment is the same for any two adjacent segments. For example, for the 12 segments of mouthpipe 12 there are 12 "steps". That is, there must be 12 gradations in inside diameter, because the inside diameter of the largest segment must be smaller than the inside diameter of the tubing leading into (38*a*), out of and comprising main slide 38. For these gradations to be equal for mouthpipe 12 having a segment 13 with an inside diameter of 0.3450 inches and the main slide 38 with an inside diameter of 0.4600 inches, the increase in inside diameter from one segment to the next larger segment must be $(0.4600-0.3450)/12=0.00958$ inches, as shown in FIG. 5. For example, the inside diameter of segment 14 is equal to the inside diameter of segment 13 (0.3450 inches) plus 0.00958 inches or 0.3545 inches. The inside diameter of segment 15 is equal to the inside diameter of segment 14 (0.3545 inches) plus 0.00958 inches or 0.3641 inches, and so on.

Figure 4:
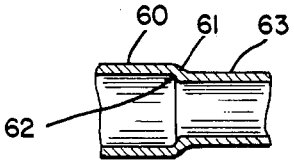
FIG. 4 is an enlarged fragmentary sectional view of the transition between two segments of an instrument incorporating the improvement of the present invention.

The diameter of segment 13 of mouthpipe 12 depends, as mentioned above, on the largest diameter of tubular section 11*a* of mouthpiece 11. It is well known that tubular section 11*a* comes in a variety of standard diameter sizes. The inside diameters of main slide 38 and tube 39 also come in a variety of standard sizes. The diameters indicated in FIG. 4 are merely illustrative. Thus, it is necessary to vary the inside diameters of segments 13–24 accordingly such that the segment 13 has an inside diameter equal to the largest inside diameter of section 11*a* and that the inside diameter of segment 24 will be incrementally smaller than the diameter of tube 38*a*, main slide 38 and tube 39. In addition, the inside diameters of segments 14–24 each increase by the same incremental amount over the preceding smaller segment.

To obtain the greatest improvement potential of the present invention the segmented tubular section of the wind instrument in question, mouthpipe 12 of the trumpet of FIGS. 1 and 2, for example, will have 12 segments. Twelve is the number of semitones in an octave, minus one. As can be seen in FIGS. 1, 2 and 3, mouthpipe 12 has 12 segments. Two segments are completely covered by overpipe 12*a* as shown in FIG. 3. The remaining 10 are shown in FIG. 1.

The thirteenth "segment" completing the octave comprises the length of tubing from the very end of segment 24—the last "step"—to the sound emitting end of bell 54. The length of this portion of the sound path is equal to an octave multiple of the note corresponding to segment 13. If as shown in FIG. 5, segment 13 corresponds to the wave length of a B flat, the length of said portion will also correspond to the wave length of a B flat, albeit in a lower octave than that of segment 13.

Another important feature of the mouthpipe or any elongated tubular section of a wind instrument made according to my invention is that as shown in FIG. 4, the boundary 61 between each segment and the next adjacent segment must be made from a softer material than the walls of the segments themselves. The method by which I achieve this will be explained in detail below. However, an example of the materials used will be illustrative.

I found, for example, if the segments are made from work hardened brass and the boundaries are not work hardened, the "trueness" of each note to an ideal chromatic scale is greatly enhanced. The same is true for instruments made from silver or other metals.

Figure 6:
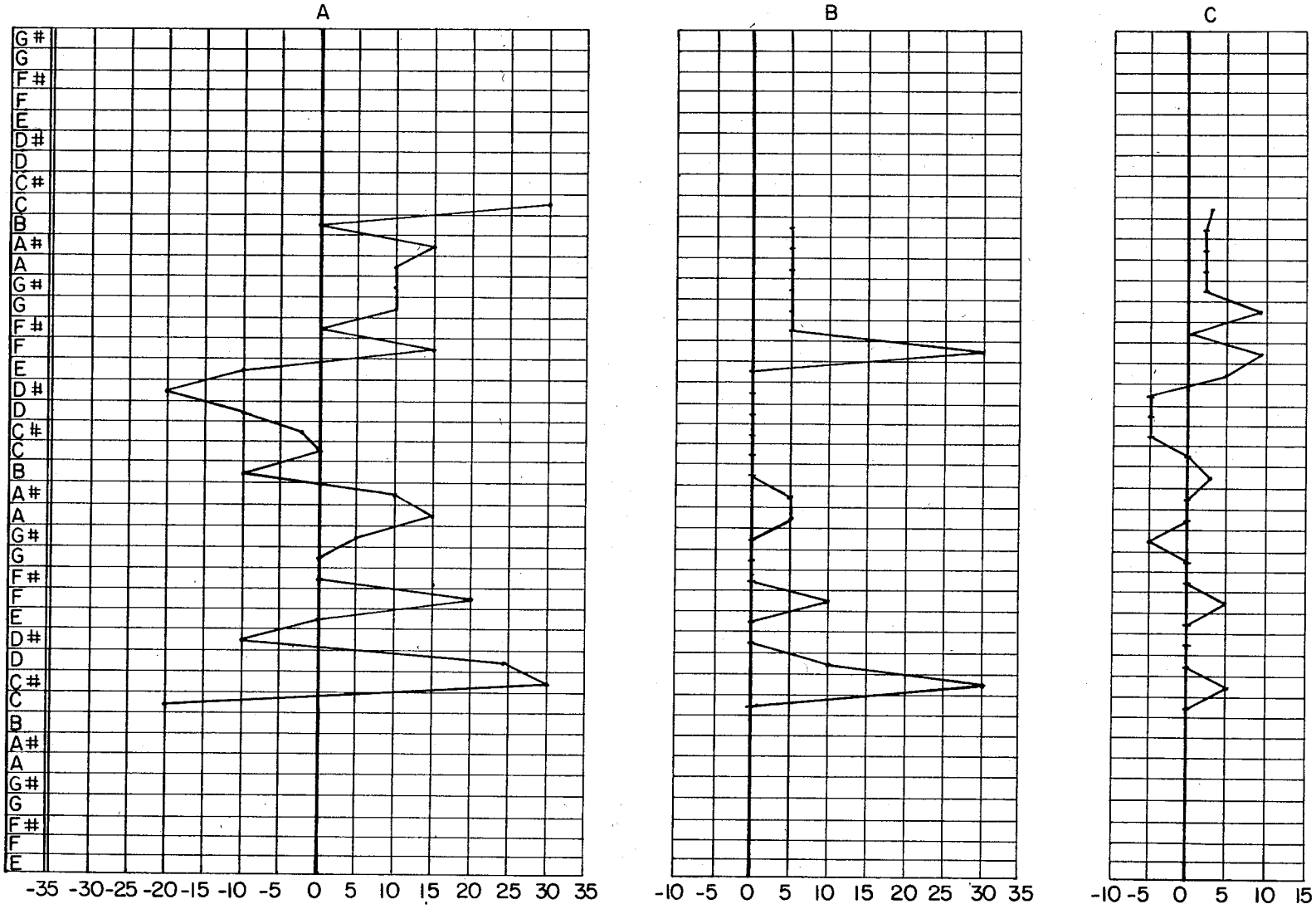
FIGS. 6A–C are three graphs of deviations in semitones of the chromatic scale produced by a prior art trumpet having a conventional construction (6A), a trumpet having the improvement of the present invention (6B) and a trumpet having the improvement of the present invention, several additional corrections having been made to the trumpet (6C)

A trumpet incorporating the improved segmented mouthpipe (but without the segmented bell stem 40 shown in FIGS. 1 and 2) of the present invention is compared against a prior art trumpet in FIG. 6. FIG. 6A represents the sound produced by a Yamaha 632 as obtained from the manufacturer. The various notes produced by the Yamaha 632 over a two octave range are represented on the ordinate. The abscissa represents flatness or sharpness of each note. The units shown on the abscissa are hundredths of a semitone, a semitone being 1 of 13 half steps in an octave, as indicated above.

As shown in FIG. 6A, two notes, the highest C and the lowest C sharp, are almost a third of a semitone sharp. The lowest C is a fifth of a semitone flat. This means the difference between the lowest C and the lower C sharp is half again what it should be. Three other notes are at least a fifth of a semitone off key: lower D, lower F and upper D sharp. Eleven other notes are at least 10/100ths of a semitone sharp or flat. Only six notes of the 25 are true (i.e. on the zero line).

Adding a stepped mouthpipe to the Yamaha 632 improves the tone remarkably as shown in FIG. 6B. Two notes are almost a third of a semitone sharp. Neither of these notes is preceded by a flat note which would otherwise accentuate the sharpness of either note as is the case above. Moreover, none of the rest of the notes is more than 10/100ths sharp. Nine notes are a negligible 5/100ths sharp. Almost half of the 25 notes are true to scale (i.e. on the zero line).

As illustrated in FIG. 6C, if 3/16ths of an inch is added to the first valve slide 33 and $\frac{3}{4}$ of an inch is added to the third valve slide 35, the two extreme sharps are eliminated with a small sacrifice in the number of notes true to scale. Ten notes are true to the scale as opposed to twelve in the "uncorrected" horn of the present invention.

Such may not even be a sacrifice when one considers that five other notes are a bearly noticeable 2.5/100ths of a semitone sharp and that the "worst" notes are less than 10/100ths of a semitone sharp. In fact, of the 15 notes not "true to scale", 13 were 5/100ths of a semitone or less off key. No other trumpet has ever been so true to scale.

These "corrections" can be made to the first and third valve slides of any trumpet. It is well known that an "ideal" first valve slide is supposed to correspond in length to the difference in wave lengths of two notes one semitone apart and an "ideal" third valve slide to a one and one-half semitone wave length difference. Of course, these lengths depend on the portion of the musical scale which the instrument is designed to play.

Because of the compromise referred to earlier, these two slides are generally made shorter than these "ideal" lengths. The corrections made when the mouthpipe of the present invention is added merely involve lengthening the first and third valve slides (i.e. pulling the slides outwardly) to their "ideal" lengths—one semitone and one-half semitone wave length differences, respectively.

Figure 7:
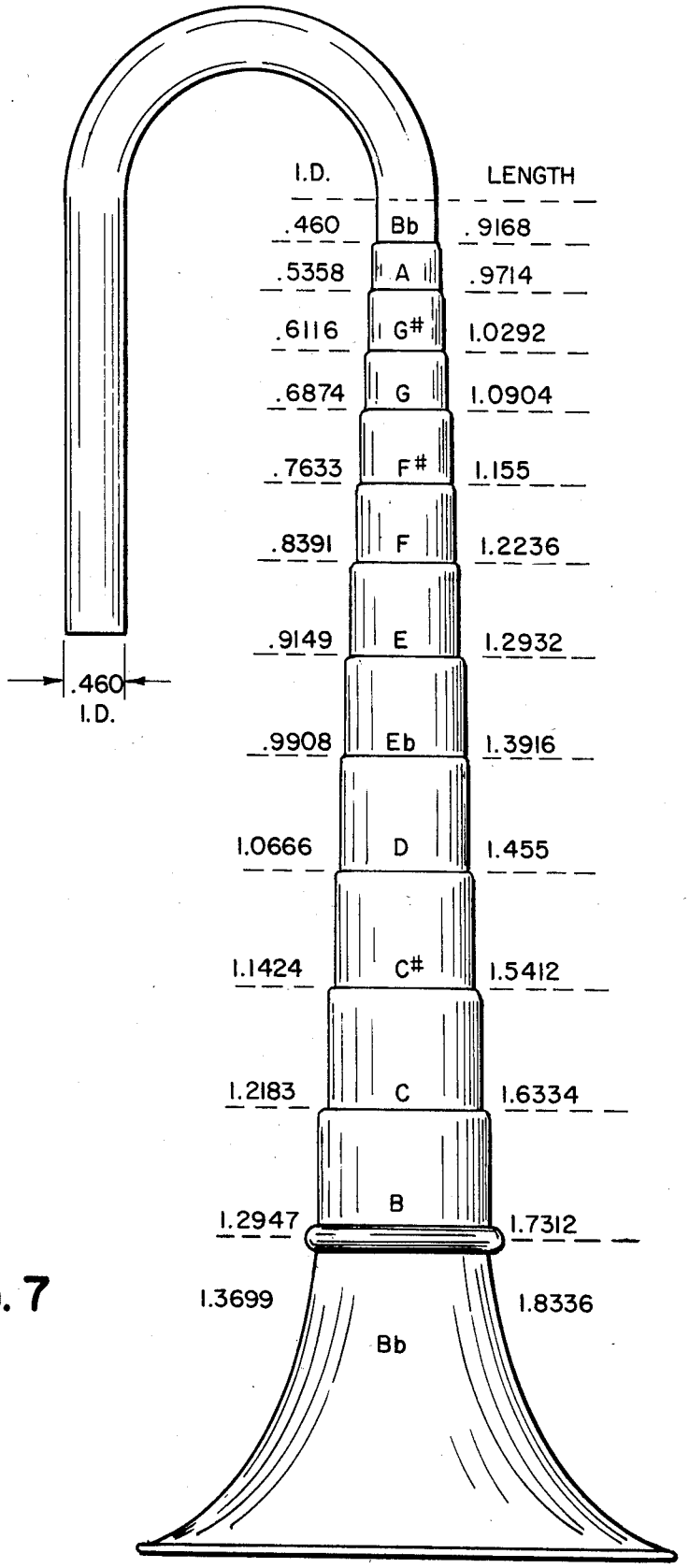
FIG. 7 is a side view of a segmented bell stem and bell of a trumpet incorporating the present invention.

As shown in FIGS. 1 and 2, the bell stem of a trumpet can also be fashioned with 12 segments of increasing lengths and diameters similar to the mouthpipe. As shown in FIGS. 1, 2 and 7, each segment 42–53 increases in length, the length corresponding to the wave length of a note in a chromatic scale. The diameters also increase, the diameter of the first segment 41 being incrementally larger than the diameter of tubular section 39. The last section 53 forms a bell 54. Therefore, the diameter of the last section 53 increases in the direction sound moves through the trumpet. The length of the last section 53 corresponds to a wave length of a note in a chromatic scale. However, the smallest diameter of bell 54 is a standard size for trumpets, the bell 54 of a trumpet being threadably received on the bell stem at 56 on the boundary between segments 52 and 53 and the threadable connection between the bell 54 and the bell stem 40 being a standard size. Therefore, the diameters of segments 42–52 increase incrementally from the standard diameter of the tube 39 to the standard smallest diameter of bell 54. With the exception of bell 54, each segment has a constant diameter throughout its length. The lengths and inside diameters of the segmented bell stem of one trumpet are shown in FIG. 7.

The thirteenth "segment" completing the octave of the bell stem 40 and bell 54 is the portion of tubing between the beginning of segment 13 (the first end of trumpet 10) and the beginning of segment 42. The length of this portion of the sound path is equal to an octave multiple of the note corresponding to segment 53. If segment 53 corresponds to a B flat, the length of said portion will also correspond to the wave length of a B flat, albeit in a lower octave than that of segment 13.

In making a trumpet, for instance, with two segmented tubular sections as shown in FIGS. 1 and 2, care should be taken to insure that the length of the tubing between the end of segment 24 to the beginning of segment 42 is equal to the wave length of a note in a chromatic scale without any of the three valves being depressed. Typically, this note will be B flat considering that trumpets are tuned to B flat and because segments 13 and 53 are B flat as indicated in FIGS. 5 and 7. Because the length of tubing between the end of segment 24 and the beginning of segment 42 is equal to the wave length of B flat, there is no need to have specifically stepped segments corresponding to segments "25" and "41" (unnumbered) which would otherwise be shown in FIGS. 1 and 2.

As noted above, segment 13 corresponds in length to the wave length of a B flat. Increasing 13 semitones from B flat means that a segment 25 would also be tuned to a B flat, "segment 25" actually corresponding to the length of tubing between the end of segment 24 to the beginning of segment 42 or to the end of bell 54. "Segment 41", of course, would correspond to a B flat and as such corresponds to the length of the tubing between the end of segment 24 and the beginning of segment 42 (or to the length of tubing from the beginning of section 13 to the beginning of segment 42). Adding 13 semitones to the B flat of segment 41 means that the length of bell 54 must also correspond to the length of a B flat wave. In other words, the entire horn corresponds in length to the wave length of a B flat which is typical of trumpets. Of course, a wind instrument can be constructed to be tuned to a different key, consistent with the teachings of the present invention, provided at least one tubular section having segments arranged in tandem of increasing diameters and lengths in the direction that sound moves through the tube is provided wherein the length of each segment corresponds to the wave length of a note in a chromatic scale.

Although straight tubular sections have been segmented in the embodiments shown in FIGS. 1 and 2, curved tubular sections of the type characteristic in French horns can also be segmented in the same fashion, the lengths increasing and corresponding to wave lengths of notes in a chromatic scale. The lengths of the curved segmented portions should be measured along a line intersecting the center of any section taken through the curved tube.

METHOD OF MANUFACTURE

Figure 8:
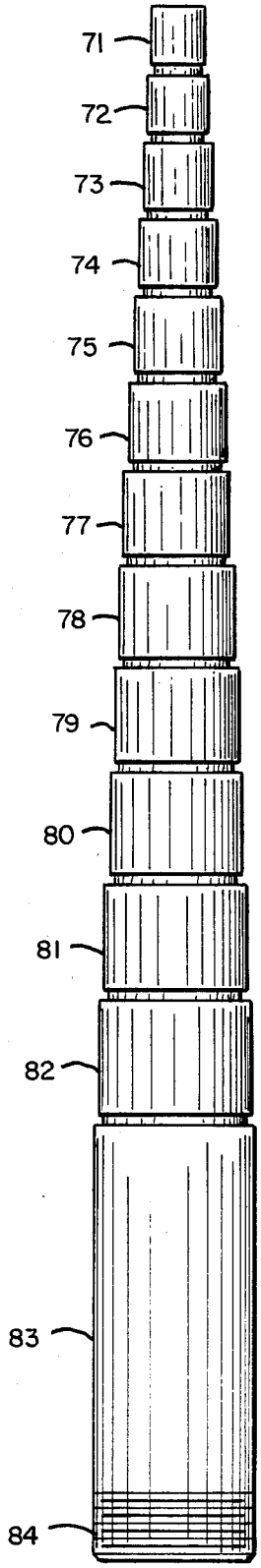
FIG. 8 is a side elevation of a mandrel used in producing the improvement of the present invention, the mandrel shown in FIG. 7 being symmetrical about any plane intersecting its longitudinal axis.

A straight segmented tubular section of the present invention such as a mouthpipe is made on a mandrel as shown in FIG. 8. The mandrel in FIG. 8 has a circular cross section and throughout its length is symmetrical about its longitudinal axis.

Mandrel 70 includes 12 segments 71–82, each separated from adjacent segments by an annular groove 88 with a groove **82*a* separating segment 82 from shank 83**. The length of each segment is such that the length of the segment is equal to the desired length of each mouthpipe or bell stem segment.

The diameters of segments 71–82 increase progressively from segment 71 to segment 82. These diameters equal the inside diameters of the segments of the finished mouthpipe or bell stem. The dimensions of grooves **71*a*–82*a* are important. The grooves should be dimensioned such that after the mouthpipe or bell stem is subjected to the swaging process described below, a boundary of softer material 61 is formed between any two adjacent segments (FIG. 3). The metal in the walls of the segments is harder as the result of work hardening produced by the swaging. Furthermore, an abrupt step 62** must be formed between segments.

For a trumpet mouthpipe, grooves 88 should be about 3/64 of an inch wide and have a radial depth of about 1/32 inch. The grooves in the bell stem mandrel, however, should be 3/16 inch wide and 3/32 inch deep. These dimensions have been found by me to result in a trumpet having excellent sound qualities and being truer to scale than prior art instruments.

Figure 9:
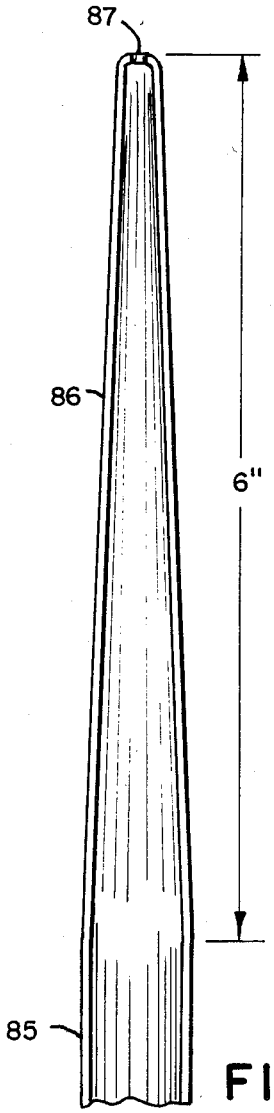
FIG. 9 is a side elevation of a tapered tube used in manufacturing the stepped mouth pipe of the present invention, the tapered tube being symmetrical about any plane intersecting its longitudinal axis.

Integral with the larger end of mandrel 70 is a shank 83 having a threaded portion 84 for connection to an hydraulic unit for purposes which will become apparent. To make a segmented mouthpipe, for instance, on mandrel 70, a tube of a brass-nickel alloy or other suitable material and having a diameter about equal to the diameter of the largest diametered segment 82 is completely annealed. About six inches of one end 86 of the tube 85 is spun down on a tapered mandrel (as opposed to the stepped mandrel 70) on a lathe so that one end is tapered to a diameter about equal to the diameter of the smallest segment 71 of mandrel 70. The small end is then crimped at 87 as shown in FIG. 9 such that when mandrel 70 is inserted therein, longitudinal displacement of the mandrel 70 in the tube beyond the crimped end is prevented.

Before being telescopically inserted onto mandrel 70, the tube 85 is again completely annealed. The tapered tube is then telescopically inserted onto mandrel 70, the tapered tube being of sufficient length such that shank 83 is the only portion of mandrel 70 not covered by the tube.

Shank 83 is connected to a hydraulic unit and the tapered tube and the mandrel are hydraulically pushed through the bore of a lead lock, the bore having a diameter slightly smaller than the diameter of the smallest segment 71 of mandrel 70. This swages the tube down against the mandrel and work hardens the tube except at the boundary portions between the adjacent segments. The boundary portions are not work hardened because the annular grooves between the segments prevent the boundary portions from being drawn as the metal is squeezed tightly against a hard mandrel surface by the lead block.

Figure 11:
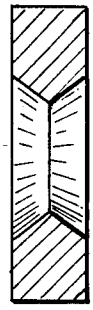
FIG. 11 is a cross section of the block of FIG. 10 taken along the line XI—XI of FIG. 10.
Figure 10:
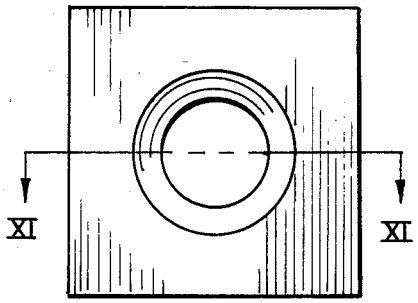
FIG. 10 is a front elevation of a metal block having a bore therethrough used in making a straight segmented tubular section of a horn.

The configuration of a typical lead block used in work hardening a segmented tubular portion of an instrument is shown in FIGS. 10 and 11. The block has an opening 90 therethrough with annular chamfered edges 92, 93 around each side of opening 91 defining a central constricted throat 94.

The edges of opening 91 are chamfered at 92 and 93 to provide a guide for the insertion of the tube and mandrel 70 into the opening 91, and to prevent lead from flaking from the other side of opening 91 as the tube and mandrel are forced therethrough. The degree of chamfer is not critical. However, the maximum diameter of the chamfer of opening 91 should be greater than the outside diameter of the smallest diameter portion of the tapered tube.

The diameter of the constricted portion 94 is less than the inside diameter of the smallest segment to be work hardened. How much smaller will determine the degree of work hardening. I find that for a mouthpipe having a smallest segment with an inside diameter of 0.345 inches as shown in FIG. 4, for instance, an opening 94 having a diameter of 0.300 to 0.310 inches works very well.

The thickness of the lead block is not critical. A thickness of about $\frac{7}{8}$ of an inch works very well.

The tube can be further work hardened by hydraulically driving it through a bore in an aluminum block, the block having dimensions identical to that of the lead block described above, except that it is only $\frac{1}{8}$ inch thick. Again, the boundary portions between adjacent segments of the tube are not work hardened because the metal therein is forced into grooves 88 and is not subjected to as much deformation as the segments 71–82 by the block.

Driving the segmented tube through an aluminum block is not always necessary. In some cases, the lead block will provide clear segmentation between the segments. Once clear segmentation is achieved, no further work hardening is needed. By "clear segmentation," I mean a sharp step between adjacent segments, an abrupt change in diameter from one segment to the next, as shown in FIG. 4.

In some circumstances, only a gradual change in diameter between segments will be achieved by swaging the tube through a lead block. In such circumstances, the tube must be swaged through an aluminum block.

I have found that the tubular segments of a tube driven through an aluminum block will frequently be too hard such that the sound produced by a horn having such tubular segments will be tinny and harsh even though clear segmentation is achieved. Therefore, I frequently reanneal the tubular section having such segments to soften the metal and then swage the tubular section through a second lead block having the same dimensions as the first in order to harden the segments (but not the boundary portions) to the desired degree.

To manufacture a curved segmented tube for a French horn, for example, a split die having curved segmented channels in each half of the die corresponding in curvature and shape to the segmented tube of the wind instrument to be produced is used. There are no grooves between adjacent segments as is the case with the mandrel. The reason for this will become apparent. A tapered tube is heated to a point where it is red hot and then cooled to room temperature. It is put in the split mold. Hydraulic pressure, either oil or water under pressure, is applied to the large diametered end of the tube in the split die. If sufficient pressure is delivered, the tube will expand outwardly against the walls of the split die. The segments of the channels which form the walls inside the die against which the tapered tube expands results in the tapered tube becoming segmented. No grooves are provided in the stepped segment in the split die in this method of making the segmented, curved tube because the hydraulic pressure will typically force metal into the grooves. It is not desirable to have the metal of the tube project radially outward between any two segments. This method results in clear segmentation.

In general, better sound is produced in a horn having a straight segmented tube than in a horn having a curved, segmented tube. Therefore, I prefer making wind instruments with straight segmented tubes, if possible. However, as indicated above, it is not possible to do so with all horns. It is frequently very difficult to do so with some types of French horns, for instance.

Of course, it is understood that the above is merely a preferred embodiment of the invention and that various changes and alterations may be made without departing from the spirit and broader aspects of the invention.

I claim:

1. In a musical wind instrument of the type in which the pitch of the note to be produced is initially created by the person blowing the instrument, the instrument having at least one elongated tubular section forming a sound path with two ends, the improvement in the instrument comprising said section having twelve arranged in tandem, the length and diameter of each segment being progressively greater in the direction the sound travels through the section, the length of each segment corresponding to the wave length of a different note of a chromatic scale, the boundary between adjacent segments being formed by an abrupt change in diameter.

2. The instrument recited in claim 1 wherein the first end of said section is connected to a portion of said tubular sound path leading to one end of said instrument's sound path, the length of said portion being substantially equal to the wave length of a note of a chromatic scale, said note being an octave multiple of the note of the segment at the second end of said section.

3. The instrument recited in claim 1 wherein the inner diameter of each segment is constant throughout its length.

4. The instrument recited in claim 3 wherein the instrument is made of metal, the metal forming the walls of each segment being work hardened, the metal in each of the boundaries being softer than that of segment walls.

5. The instrument recited in claim 3 wherein the boundary at the end of each section is located at the antinode of the chromatic note having a wave length which is a precise multiple of the section's length.

6. The instrument recited in claim 5 wherein the walls of said segments are of a harder material than the material forming the boundaries.

7. The instrument recited in claim 1 wherein the diameter of said segments increases in size in equal increments.

* * * * *

UNITED STATES PATENT AND TRADEMARK OFFICE

CERTIFICATE OF CORRECTION

PATENT NO. : 4,559,859

DATED : December 24, 1985

INVENTOR(S) : Eugene A. Pilczuk

It is certified that error appears in the above-identified patent and that said Letters Patent is hereby corrected as shown below:

Column 10, line 33, Claim 1:

After "twelve" insert --segments--.

Signed and Sealed this

Ninth Day of December, 1986

*Attest:*

DONALD J. QUIGG

*Attesting Officer*

*Commissioner of Patents and Trademarks*